US010064468B2

(12) United States Patent
Wu et al.

(10) Patent No.: US 10,064,468 B2
(45) Date of Patent: Sep. 4, 2018

(54) EYEGLASS PROTECTORS

(71) Applicant: Arthur Wu, North Hollywood, CA (US)

(72) Inventors: Arthur Wu, North Hollywood, CA (US); Jordan William Danyluk, North Hollywood, CA (US)

(73) Assignee: Arthur Wu, Long Beach, CA (US)

( * ) Notice: Subject to any disclaimer, the term of this patent is extended or adjusted under 35 U.S.C. 154(b) by 0 days.

(21) Appl. No.: 15/015,127

(22) Filed: Feb. 4, 2016

(65) Prior Publication Data

US 2017/0150793 A1 Jun. 1, 2017

Related U.S. Application Data

(63) Continuation-in-part of application No. 29/546,986, filed on Nov. 30, 2015, now Pat. No. Des. 796,837.

(51) Int. Cl.

| | |
|---|---|
| ***A45C 11/04*** | (2006.01) |
| ***A45C 13/00*** | (2006.01) |
| ***A45C 13/10*** | (2006.01) |

(52) U.S. Cl.

CPC ..... *A45C 11/04* (2013.01); *A45C 13/005* (2013.01); *A45C 13/1069* (2013.01)

(58) Field of Classification Search

CPC ..... A45C 11/04; A45C 11/043; A45C 13/00; A45C 13/005; A45C 13/1069; A45C 11/005; B65D 51/00

USPC ..... 206/5, 6; 190/902; 220/230, 810–849

See application file for complete search history.

(56) References Cited

U.S. PATENT DOCUMENTS

| | | | | |
|---|---|---|---|---|
| 2,277,371 | A | 3/1942 | Simpson | |
| 2,723,745 | A | 11/1955 | McNeill | |
| 2,762,500 | A | 9/1956 | Parsell | |
| 2,918,959 | A | 12/1959 | Bloch | |
| 3,033,359 | A | 5/1962 | Mercer | |
| 3,921,797 | A | 11/1975 | Platt | |
| 4,267,923 | A | 5/1981 | Baratelli | |
| 4,290,522 | A * | 9/1981 | Takasaki | A45C 11/04 206/5 |
| 4,823,943 | A | 4/1989 | Chang | |

(Continued)

FOREIGN PATENT DOCUMENTS

JP 2016-93429 A * 5/2016 ..... A45C 11/04

OTHER PUBLICATIONS

LensShield—downloaded on Jan. 22, 2016 from www.lensshield.com.

(Continued)

*Primary Examiner* — Bryon Gehman

(57) ABSTRACT

The disclosure includes a lens jacket configured to cover an eyeglass frame comprising a first lens and a second lens connected. Embodiments of the lens jacket can include a soft material that extends along a first direction and a second direction. The soft material can comprise an inner surface and an outer surface. Embodiments of the lens jacket can also include a pivot axis that extends through the soft material and extends parallel to the first direction, a first attachment mechanism located along the first portion of the soft material, and a second attachment mechanism located along the second portion of the soft material. The first attachment mechanism can couple with the second attachment mechanism to thereby retain the soft material in a closed position to thereby protect the first and second lenses.

20 Claims, 18 Drawing Sheets

(56) References Cited

U.S. PATENT DOCUMENTS

| | | | | |
|---|---|---|---|---|
| 4,984,682 | A | 1/1991 | Cummins | |
| 5,031,874 | A * | 7/1991 | Shannon | A47G 1/17 220/230 |
| 5,032,019 | A * | 7/1991 | Burchett | A45C 11/04 206/5 |
| 7,770,721 | B2 * | 8/2010 | Orner | A45C 11/04 206/5 |
| 8,789,689 | B1 * | 7/2014 | Wong | A45C 7/0036 206/6 |
| 8,893,879 | B2 * | 11/2014 | Scribner | A45C 11/043 206/5 |
| 9,066,567 | B2 * | 6/2015 | Rouzeau | A45C 11/043 |
| 2009/0057165 | A1 | 3/2009 | Park | |
| 2014/0138263 | A1 | 5/2014 | Rouzeau | |
| 2016/0021999 | A1 * | 1/2016 | Harada | A45C 11/04 206/5 |

OTHER PUBLICATIONS

Makr Eyewear Sleeve—downloaded on Jan. 22, 2016 from www.freemanbrand.com/journal/makr-eyewear-sleeve-kh.

Tanner Goods Sunglass Case—downloaded on Jan. 22, 2016 from www.endclothing.com.

MEKU Handmade Leather Eyeglass Case—downloaded on Jan. 22, 2016 from www.amazon.com/MEKU-Handmade-Leather-Eyegalsses-Sunglass/dp/B00PK01090/.

* cited by examiner

EYEGLASS PROTECTORS

CROSS-REFERENCE TO RELATED APPLICATIONS

This application claims the benefit and priority of U.S. Design patent application No. 29/546,986; filed Nov. 30, 2015; and entitled EYEGLASS PROTECTOR; the entire contents of which are incorporated herein by reference.

BACKGROUND

Field

The invention is generally directed to eyeglasses, and more specifically, to eyeglass protectors.

Description of Related Art

Eyeglasses include lenses for vision correction. The lenses are often made of glass and can be delicate and susceptible to being scratched, which can impair vision correction. To protect the eyeglass lenses, people often enclose their eyeglasses in protective cases or covers.

While protective cases can securely protect the eyeglass lenses, some drawbacks are that cases can be bulky, awkward, and difficult to carry around. To remedy this shortcoming, people often use protective covers, which are lower profile than protective cases. However, because protective covers are composed of flimsy material they often provide minimal and inadequate protection to securely safeguard the eyeglass lenses. Accordingly, there is a need for a low profile eyeglass protector that securely protects the eyeglass lenses.

SUMMARY

The present disclosure includes a lens jacket configured to cover an eyeglass frame comprising a first lens and a second lens connected by a bridge. In some embodiments, the lens jacket can include a soft material that extends along a first direction and a second direction that is perpendicular to the first direction. The soft material can comprise an inner surface and an outer surface that faces opposite the inner surface. The lens jacket can also include a pivot axis that extends through the soft material and extends parallel to the first direction. The pivot axis can allow the soft material to fold towards itself such that a first portion of the inner surface faces a second portion of the inner surface.

The lens jacket can even include a first attachment mechanism located along the first portion of the soft material and a second attachment mechanism located along the second portion of the soft material. The first attachment mechanism can couple with the second attachment mechanism to thereby retain the soft material in a closed position. In some embodiments, when the soft material is in the closed position around the eyeglass frame, the first portion of the inner surface faces a first surface of the eyeglass frame and the second portion of the inner surface faces a second surface of the eyeglass frame that faces opposite the first surface. Furthermore, the soft material can define a first width that extends along the first direction, and the eyeglass frame can define a second width that extends along the first direction. In some embodiments, the second width is greater than the first width.

The eyeglass frame can include a top side, a bottom side that faces opposite the top side, a first side, and a second side that faces opposite the first side. When the soft material is in the closed position around the eyeglass frame, the top side of the eyeglass frame can face the soft material, and the first side, second side, and bottom side of the eyeglass frame may not face a portion of the soft material.

In some embodiments, the first portion defines a first area that extends along the first and second directions, the second portion defines a second area that extends along the first and second directions, and the eyeglass frame defines a third area that extends along the first and second directions. The first area can be substantially equal to the second area, and each of the first area and the second area can be greater than the third area.

The first attachment mechanism can comprise a first magnet and the second attachment mechanism can comprise a second magnet. In some embodiments, the first attachment mechanism can comprise a first plastic housing that receives the first magnet, and the second attachment mechanism can comprise a second plastic housing that receives the second magnet.

In some embodiments, the first attachment mechanism extends from the inner surface of the soft material at a upper-center location of the first portion whereby the first attachment mechanism extends along a third direction that is perpendicular to both the first direction and the second direction. Accordingly, in some embodiments, the second attachment mechanism extends from the inner surface of the soft material along a lower-center location of the second portion whereby the second attachment mechanism extends along the third direction.

The first attachment mechanism can extend a first height from the inner surface and the second attachment mechanism can extend a second height from the inner surface. The first height in addition to the second height can be greater than a first thickness of the eyeglass frame that extends along the third direction.

In some embodiments, an outer portion of the first plastic housing extends from the outer surface of the soft material at the upper-center location of the first portion whereby the first plastic housing extends along the third direction. Accordingly, in some embodiments, an outer portion of the second plastic housing extends from the outer surface of the soft material at the lower-center location of the second portion whereby the second plastic housing extends along the third direction.

The outer portion of the first plastic housing can extend a third height from the outer surface and the outer portion of the second plastic housing can extend a fourth height from the outer surface. In some embodiments, the third height is substantially equal to the fourth height. The outer portion of the first plastic housing can define a first area sized and shaped to receive a first human finger. The outer portion of the second plastic housing can define a second area sized and shaped to receive a second human finger. The first area can be substantially equal to the second area.

In some embodiments, the pivot axis is a first pivot axis. Accordingly, the lens jacket can further comprise a second pivot axis that extends through the soft material and extends substantially parallel to the first pivot axis. The second pivot axis can be spaced from the first pivot axis along the second direction. The second pivot axis can allow the soft material to fold towards itself such that the first portion of the inner surface faces the second portion of the inner surface. In some embodiments, the second pivot axis is spaced a first distance from the first pivot axis. The first distance can be greater than the first thickness of the eyeglass frame. As well, the first distance can be greater than the first height in addition to the second height.

An inner portion of the first portion of the soft material can comprise a first firm material and an inner portion of the second portion of the soft material can comprise a second firm material. In addition, an inner portion of the soft material between the first axis and the second axis can be devoid of firm material. The inner surface can comprise microfiber and the outer surface can comprise vegan leather.

In some embodiments, a first earpiece and a second earpiece are coupled to the eyeglass frame. When the soft material is in the closed position around the eyeglass frame and the first attachment mechanism can be coupled to the second attachment mechanism, the first earpiece and the second earpiece can each pivot between a inward position and an outward position.

The disclosure also includes a lens jacket configured to cover an eyeglass frame comprising a first lens and a second lens connected by a bridge. The lens jacket can include a soft material that extends along a first direction and a second direction that is perpendicular to the first direction. The soft material can comprise an inner surface and an outer surface that faces opposite the inner surface.

The lens jacket can also include a pivot axis that extends through the soft material and extends parallel to the first direction. The pivot axis can allow the soft material to fold towards itself such that a first portion of the inner surface faces a second portion of the inner surface. The lens jacket can also include a first attachment mechanism that extends from the first portion of the soft material along a third direction that is perpendicular to the first direction and the second direction. Even still, the lens jacket can include a second attachment mechanism that extends from the second portion of the soft material along the third direction. The first attachment mechanism can couple with the second attachment mechanism at a coupling location to thereby retain the soft material in a closed position.

When the soft material is in the closed position around the eyeglass frame, the first portion of the inner surface can face a first surface of the eyeglass frame and the second portion of the inner surface can face a second surface of the eyeglass frame that faces opposite the first surface. The first attachment mechanism and the second attachment mechanism can extend through an aperture of the eyeglass frame located between the first lens, second lens, and the bridge such that the coupling location is positioned between the first lens and second lens.

In some embodiments, the coupling location is further positioned between the first lens and second lens just below the bridge of the eyeglass frame. The soft material can define a first width that extends along the first direction and the eyeglass frame can define a second width that extends along the first direction. In some embodiments, the second width is greater than the first width.

The first width can be sized with respect to the second width so that the eyeglass frame is securely coupled to the lens jacket when the soft material is in the closed position around the eyeglass frame. A first earpiece and second earpiece can be coupled to the eyeglass frame. In some embodiments, when the soft material is in the closed position around the eyeglass frame and the first attachment mechanism is coupled to the second attachment mechanism, no portion of the soft material covers the first earpiece and the second earpiece.

When the soft material is in the closed position, the soft material can define a first footprint that extends along the first and second directions. The soft material can define a second footprint that extends along the second and third directions. At least a portion of the eyeglass frame can extend outside of the first and second footprints. As well, at least a portion of the first earpiece can extend outside of the first and second footprints. In some embodiments, at least a portion of the second earpiece can extend outside of the first and second footprints.

The embodiments described above include many optional features and aspects. Features and aspects of the embodiments can be combined and omitted.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments. The above and other features of the present invention will become more apparent by describing in detail exemplary embodiments thereof with reference to the accompanying drawings, in which.

DETAILED DESCRIPTION

Figure 1:
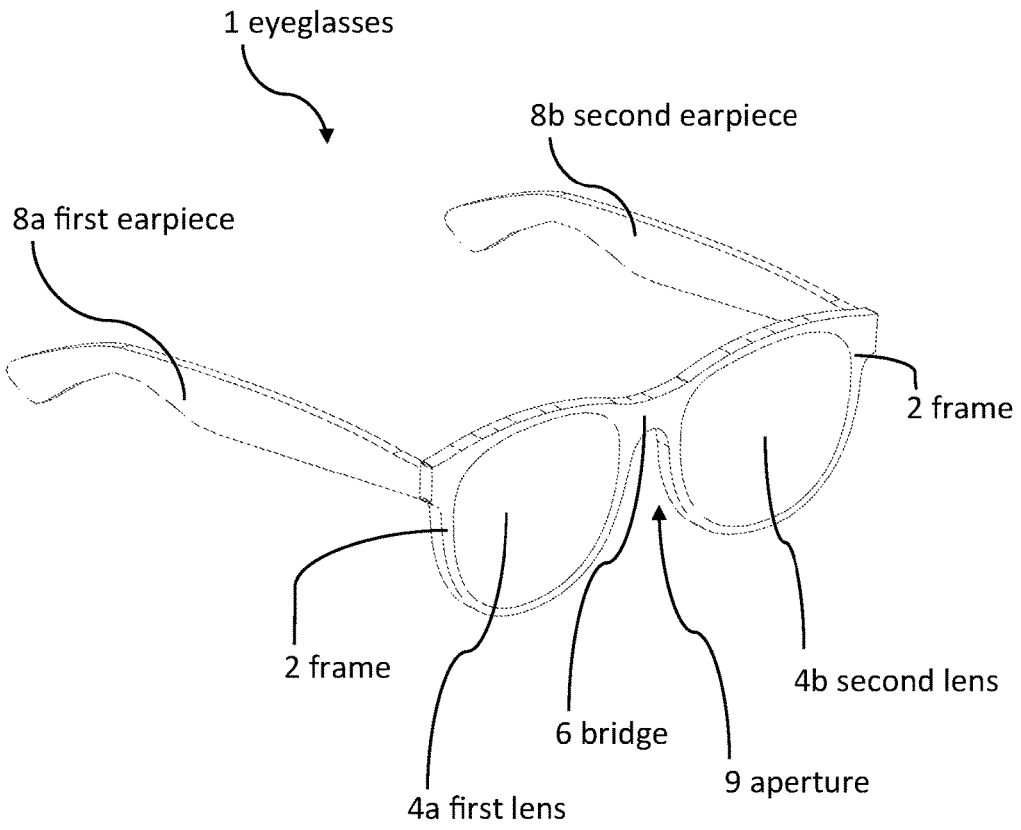
Figure 1 (Prior art)
FIGS. 1 and 2 illustrate a prior art pair of eyeglasses.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

LIST OF REFERENCE NUMERALS

1—Eyeglasses
2—Frame
4*a*—First lens
4*b*—Second lens
6—Bridge
8*a*—First earpiece
8*b*—Second earpiece
9—Aperture
10—Lens Jacket
12—Soft Material
14—Outer surface
16—Inner surface
17*a*—Inner body portion
17*b*—Inner axis portion
18*a*—First pivot axis
18*b*—Second pivot axis
20*a*—First attachment mechanism
20*b*—Second attachment mechanism
22*a*—First portion
22*b*—Second portion
24*a*—First surface
24*b*—Second surface
26*a*—First width
26*b*—Second width
27—First distance
28*a*—Top side
28*b*—Bottom side
28*c*—First side
28*d*—Second side
29*a*—Open position
29*b*—Closed position
30*a*—First area
30*b*—Second area
30*c*—Third area
32—Housing
32*a*—First plastic housing
32*b*—Second plastic housing
34—Magnet
34*a*—First magnet
34*b*—Second magnet
36*a*—Upper-center location
36*b*—Lower-center location
38*a*—First height
38*b*—Second height
40*a*—Third height
40*b*—Fourth height
42*a*—Outer portion of the first plastic housing
42*b*—Outer portion of the second plastic housing
44*a*—First area
44*b*—Second area
46—First thickness
48—Coupling location
50*a*—First footprint
50*b*—Second footprint
52*a*—Inward position
52*b*—Outward position Introduction A lens jacket 10, as disclosed, can address the disadvantages of prior art protective cases and covers, as previously described. For example, embodiments of the lens jacket 10 can securely protect eyeglass lenses. As well, the lens jacket 10 can offer a low profile, sleek design that is easily stowed and transported by a user.

Eyeglass Protector Embodiments

FIG. 1 illustrates a prior art pair of eyeglasses 1 comprising a frame 2. The eyeglasses 1 also include a first lens 4*a* and a second lens 4*b*, both of which are coupled to the frame 2. The frame 2 can also include a bridge 6 that connects the first lens 4*a* and the second lens 4*b*. Just below the bridge 6, the frame 2 includes an aperture 9, which can receive a user's nose. The eyeglasses 1 also include a first earpiece 8*a* and a second earpiece 8*b*, both of which are coupled to the frame 2. The first and second earpieces 8*a*, 8*b* can allow the eyeglasses 1 to securely couple to a user's ears.

Figure 3:
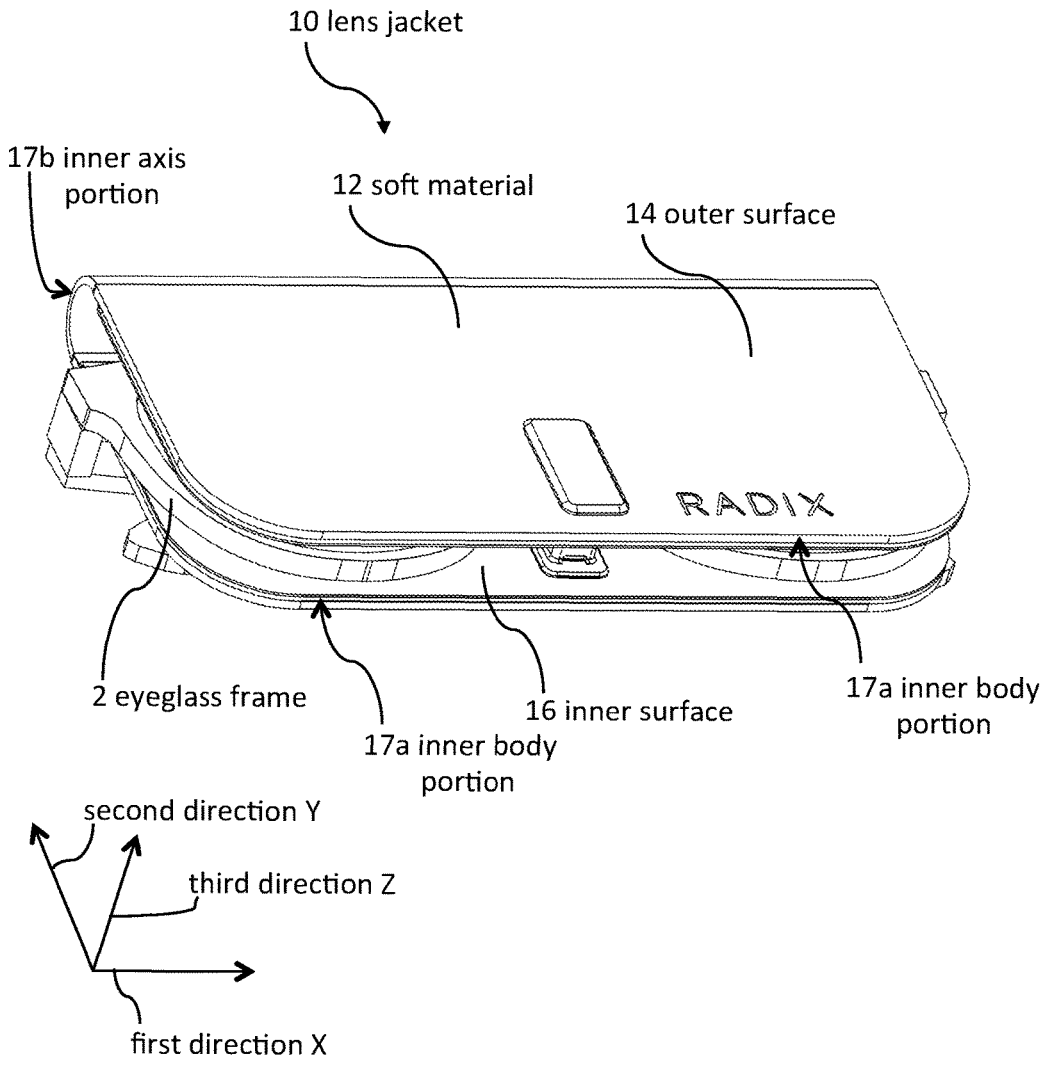
FIG. 3 illustrates a perspective front view of a lens jacket in a folded (or closed) position with a pair of eyeglasses coupled to the lens jacket, according to embodiments of the present disclosure.

Now referring to FIG. 3, the disclosure includes a lens jacket 10 configured to cover the eyeglass frame 2 comprising the first lens 4*a* and the second lens 4*b* connected by the bridge 6. The lens jacket can include a soft material 12 that extends along a first direction X and a second direction Y that is perpendicular to the first direction X. It should be appreciated that the soft material 12 can define any shape configured to cover an eyeglass frame 2, such as a square, a rectangle, an oblong shape, and the like.

As shown in FIGS. 3-6, the soft material 12 can include an inner surface 16 that is configured to touch both sides of the first and second lenses 4*a*, 4*b* without scratching the lenses. The soft material 12 can also include an outer surface 14 that faces opposite the inner surface 16. The outer surface 14 can be configured to provide a durable texture that not only protects the eyeglass lenses, but also provides a soft and elegant feel that is inviting to a user's hand. In some embodiments, the outer surface 14 comprises vegan leather, while the inner surface 16 comprises a softer material, such as a microfiber.

In some embodiments, an inner body portion 17*a* of the first portion 22*a* comprises a first firm material. Likewise, an inner body portion 17*a* of the second portion 22*b* can comprise a second firm material, which can be the same as the first firm material. The presence of the firm material can enhance the stability and provide a secure feel for the lens jacket 10.

The lens jacket 10 can be configured to move between an open position 29*a* whereby the lens jacket 10 can receive the eyeglasses 1, and a closed position 29*b* whereby the lens jacket 10 securely and protectively encloses the eyeglasses 1. Now referring to FIGS. 4 and 5, in order to move between the open and closed positions 29*a*, 29*b*, the lens jacket 10 can include a first pivot axis 18*a* that extends through the soft material 12 and extends parallel to the first direction X. The lens jacket 10 can also include a second pivot axis 18*b* that extends through the soft material 12, also parallel to the first direction X.

As illustrated in FIGS. 3-6, the first pivot axis 18*a* and the second pivot axis 18*b* can allow the soft material 12 to fold towards itself such that a first portion 22*a* of the inner surface 16 faces a second portion 22*b* of the inner surface 16. Accordingly, the soft material 12 can move between the open position 29*a* and the closed position 29*b*. In some embodiments, the second pivot axis 18*b* is spaced a first distance 27 from the first pivot axis 18*a*. As well, an inner axis portion 17*b* of the soft material between the first pivot axis 18*a* and the second pivot axis 18*b* can be devoid of firm material to thereby allow the first portion 22*a* to more easily fold towards the second portion 22*b*.

Figure 4:
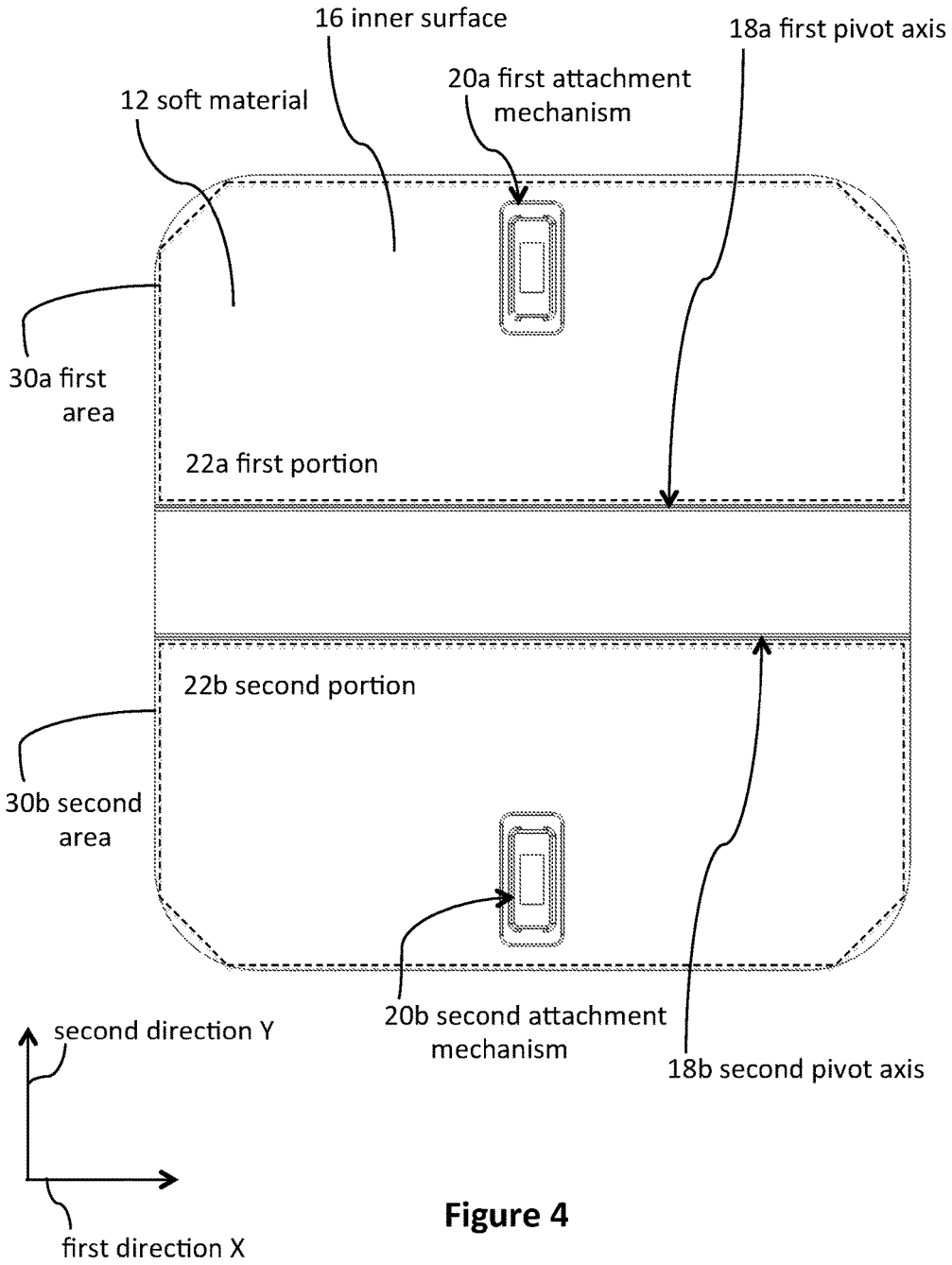
FIG. 4 illustrates a front view of a lens jacket in an open position, according to embodiments of the present disclosure.
Figure 5:
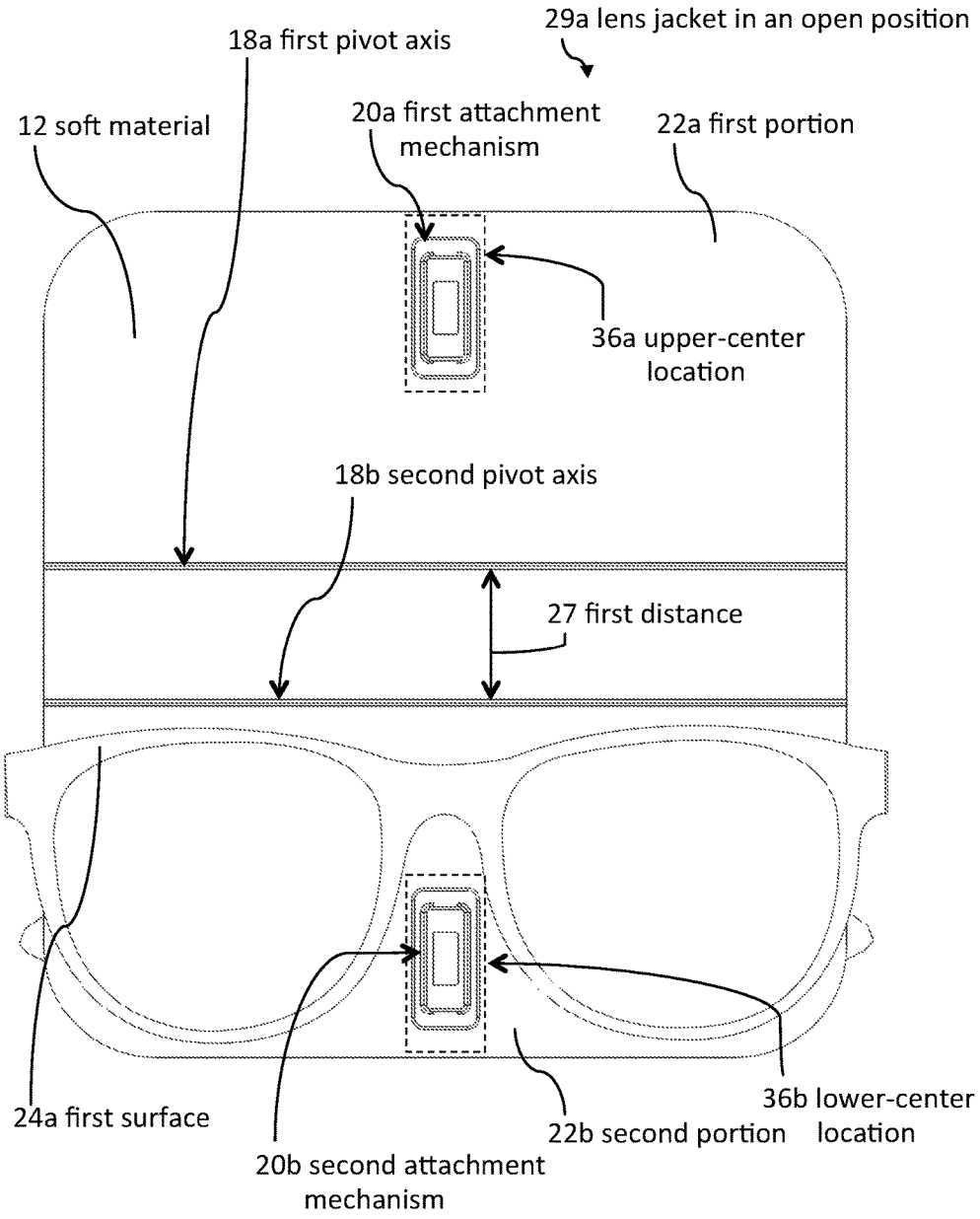
FIG. 5 illustrates a front view of a lens jacket in an open position with a pair of eyeglasses coupled to the lens jacket, according to embodiments of the present disclosure.
Figure 6:
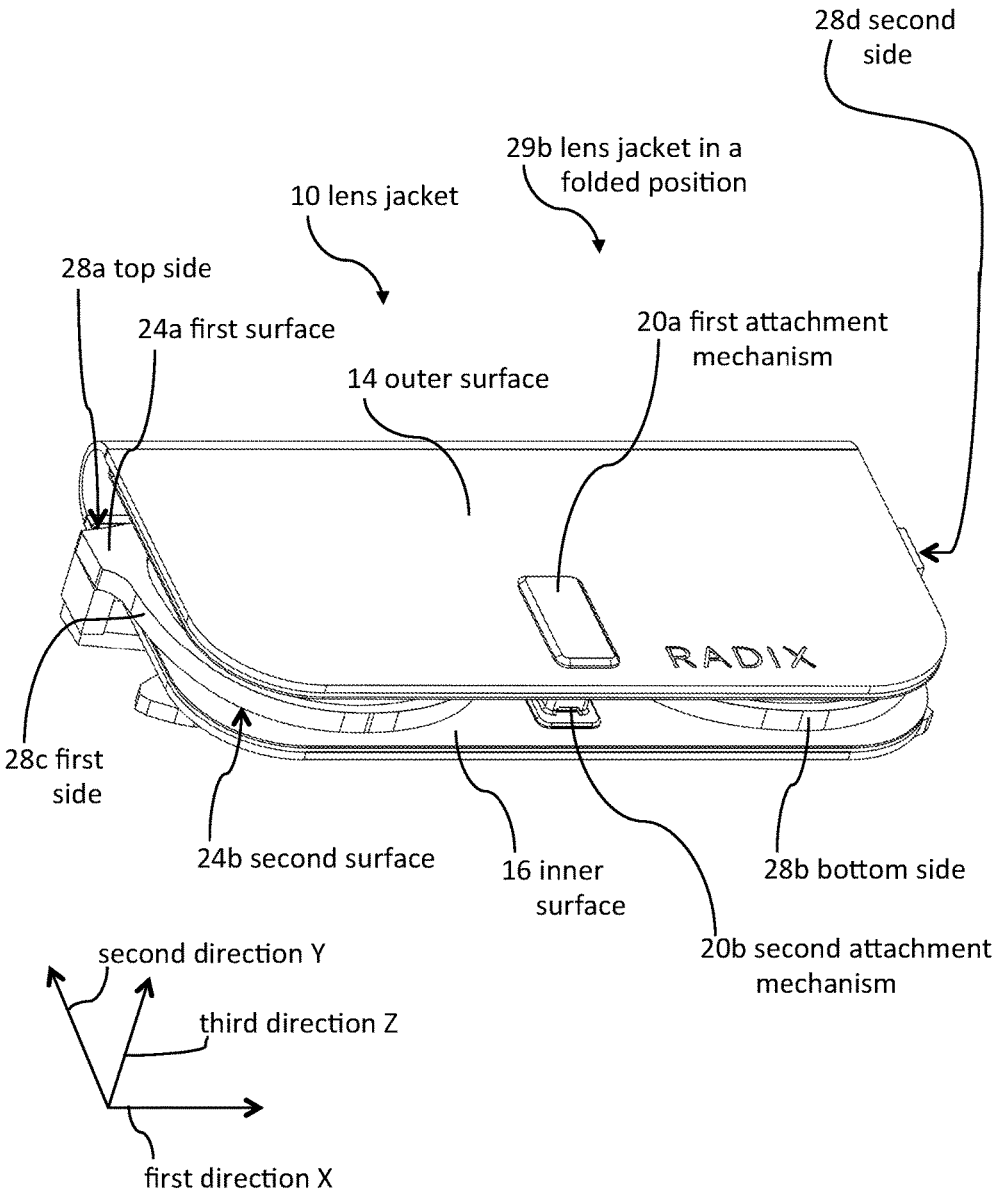
FIG. 6 illustrates a perspective front view of a lens jacket in a closed position with a pair of eyeglasses coupled to the lens jacket, according to embodiments of the present disclosure.

When a pair of eyeglasses 1 is enclosed within the lens jacket 10, the lens jacket 10 can include additional features to securely retain the lens jacket 10 in the closed position 29*b*. As shown in FIGS. 4-6, the lens jacket 10 can include a first attachment mechanism 20*a* located along the first portion 22*a* of the soft material 12 and a second attachment mechanism 20*b* located along the second portion 22*b* of the soft material 12. The first attachment mechanism 20*a* can couple with the second attachment mechanism 20*b* to retain the soft material 12 in the closed position 29*b* to thereby securely enclose the eyeglass frame 2. Furthermore, with specific reference to FIG. 6, when the soft material 12 is in the closed position 29*b* around the eyeglass frame 2, the first portion 22*a* of the inner surface 16 can face a first surface 24*a* of the eyeglass frame 2 and the second portion 22*b* of the inner surface 16 can face a second surface 24*b* of the eyeglass frame 2 that faces opposite the first surface 24*a*.

With continued reference to FIG. 4, in some embodiments, the first portion 22*a* defines a first area 30*a* that extends along the first and second directions X, Y. As well, the second portion 22*b* can define a second area 30*b* that extends along the first and second directions X, Y. Even still, the eyeglass frame 2 can define a third area 30*c* that extends along the first and second directions X, Y. In some embodiments, the first portion 22*a* and the second portion 22*b* can be symmetrical to each other and/or of equal size. Accordingly, the first area 30*a* can be substantially equal to the second area 30*b*. Each of the first area 30*a* and the second area 30*b* can be greater than the third area 30*c* of the eyeglass frame 2. This can allow the lens jacket 10 to fully cover the eyeglass frame 2 to thereby protect the frame 2 and the lenses from possible scratching or damage.

Figure 2:
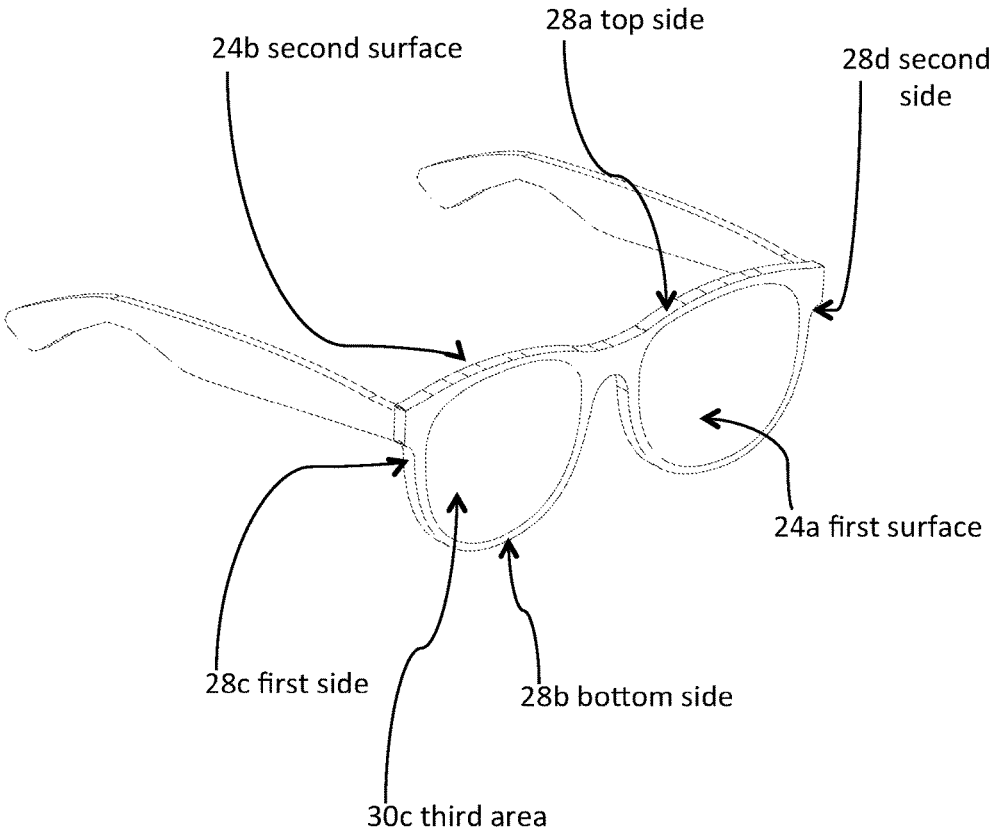
Figure 2 (Prior art)

FIG. 2 shows that the prior art eyeglass frame 2 comprises a top side 28*a*, a bottom side 28*b* that faces opposite the top side 28*a*, a first side 28*c*, and a second side 28*d* that faces opposite the first side 28*c*. According to the embodiment illustrated in FIG. 6, when the soft material 12 is in the closed position 29*b* around the eyeglass frame 2, the top side 28*a* of the eyeglass frame 2 faces the soft material 12, and the first side 28*c*, second side 28*d*, and bottom side 28*b* of the eyeglass frame 2 do not face a portion of the soft material 12.

Figure 7:
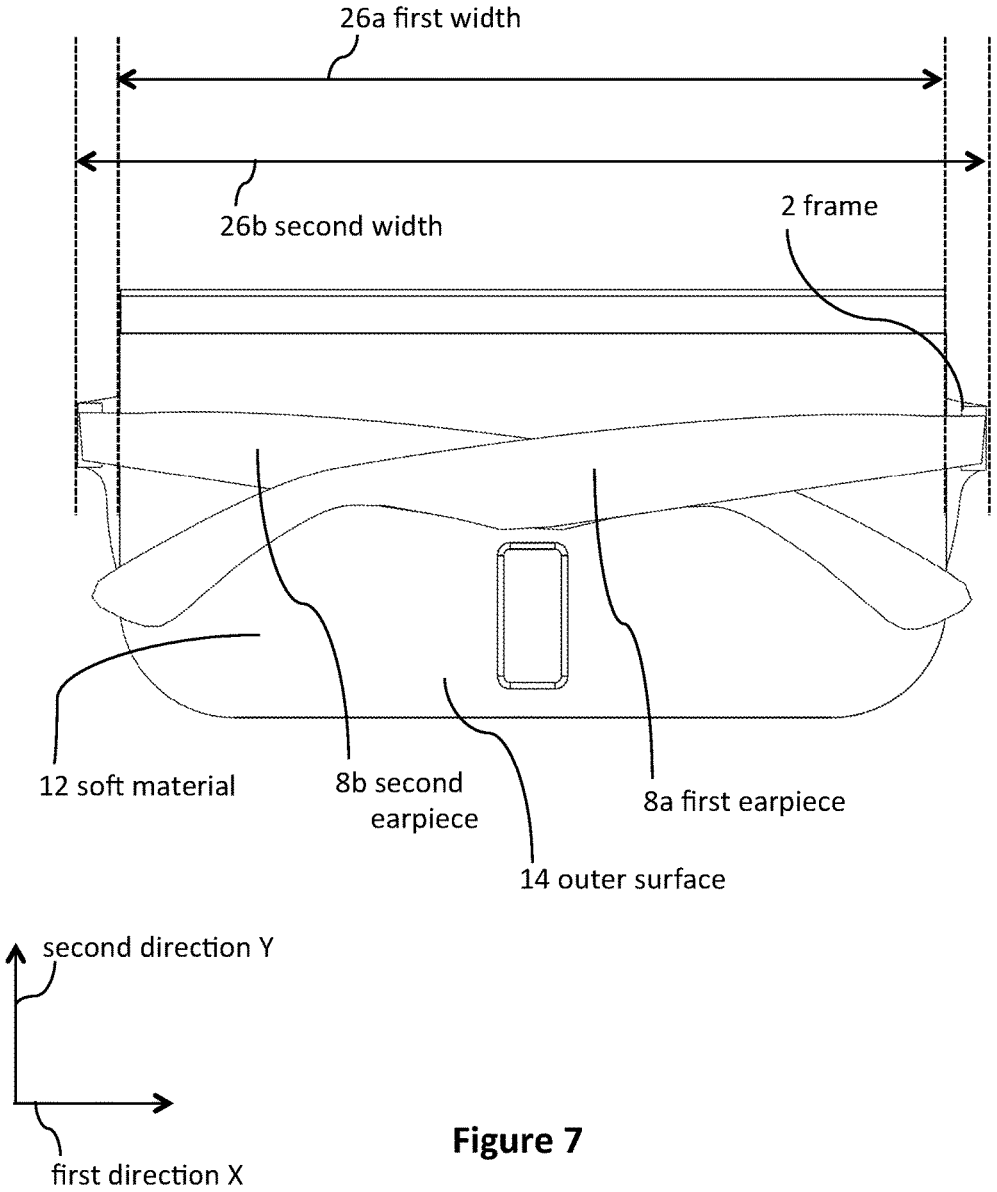
FIG. 7 illustrates a back view of a lens jacket in a closed position with a pair of eyeglasses coupled to the lens jacket, according to embodiments of the present disclosure.

As previously disclosed, the lens jacket 10 can include a low profile, minimalist design. To illustrate, FIG. 7 shows that the soft material 12 can define a first width 26*a* that extends along the first direction X. As well, the eyeglass frame 2 can define a second width 26*b* that extends along the first direction X. In some embodiments, the second width 26*b* is greater than the first width 26*a*. Even still, in some embodiments, the first width 26*a* is sized with respect to the second width 26*b* so that the eyeglass frame 2 is securely coupled to the lens jacket 10 when the soft material 12 is in the closed position 29*b* around the eyeglass frame 2. Accordingly, the first width 26*a* of the soft material 12 may be dependent upon the second width 26*b*. In this regard, embodiments of the lens jacket 10 may be sized in different widths to fit the various widths and styles of eyeglass frames 2.

Figure 8:
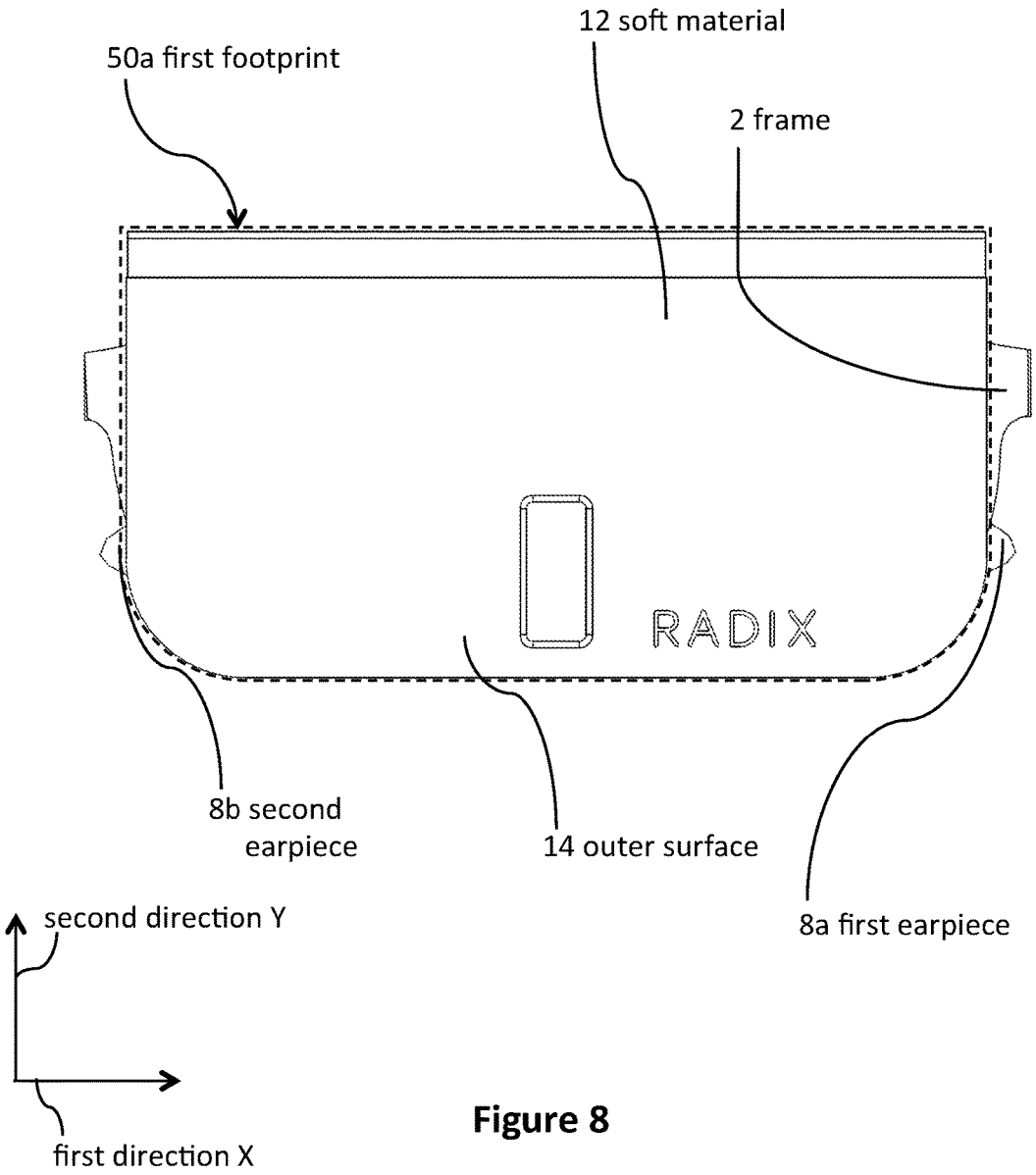
FIG. 8 illustrates a front view of a lens jacket in a closed position with a pair of eyeglasses coupled to the lens jacket, according to embodiments of the present disclosure.
Figure 9:
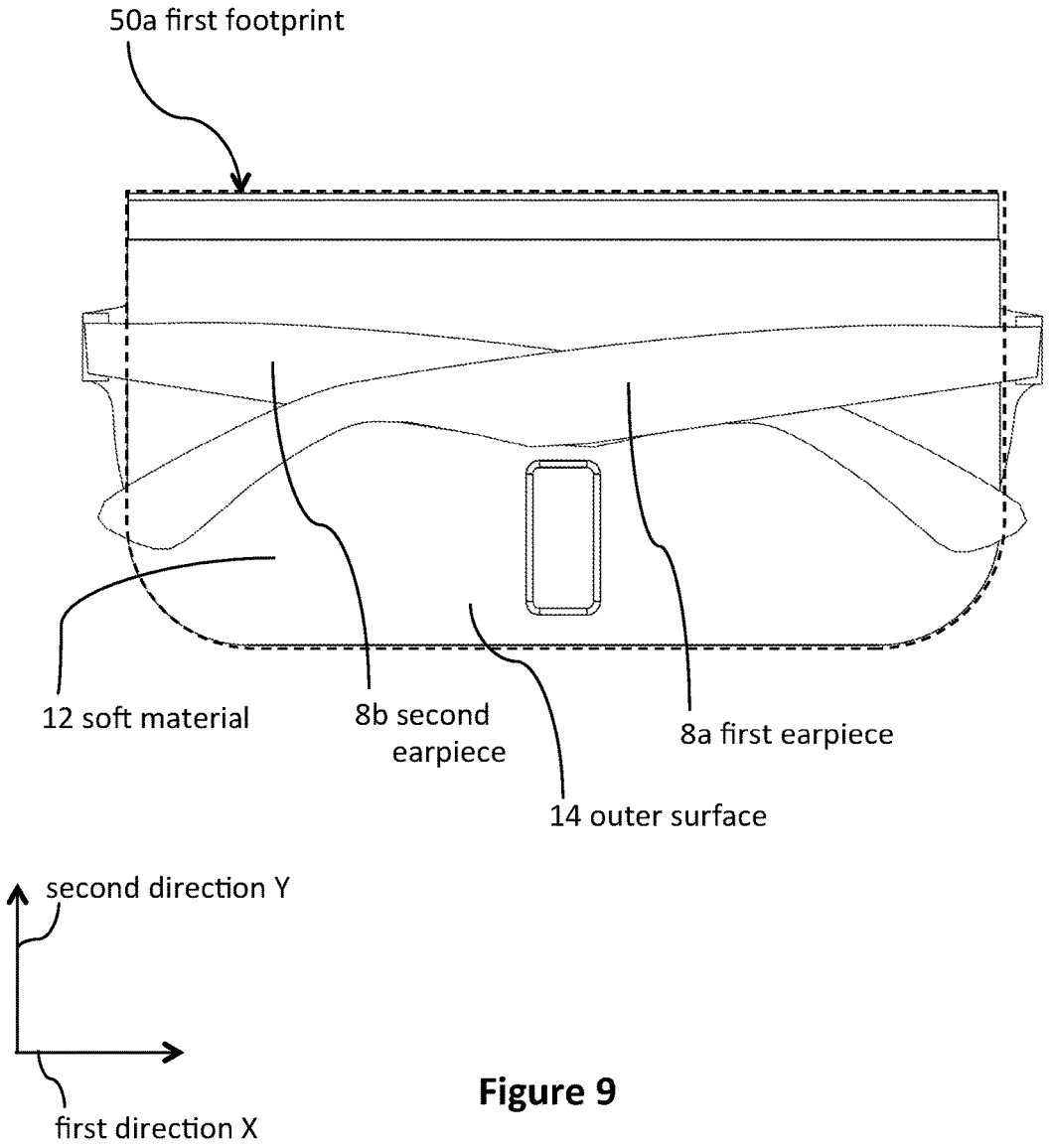
FIG. 9 illustrates a back view of a lens jacket in a closed position with a pair of eyeglasses coupled to the lens jacket, according to embodiments of the present disclosure.
Figure 10:
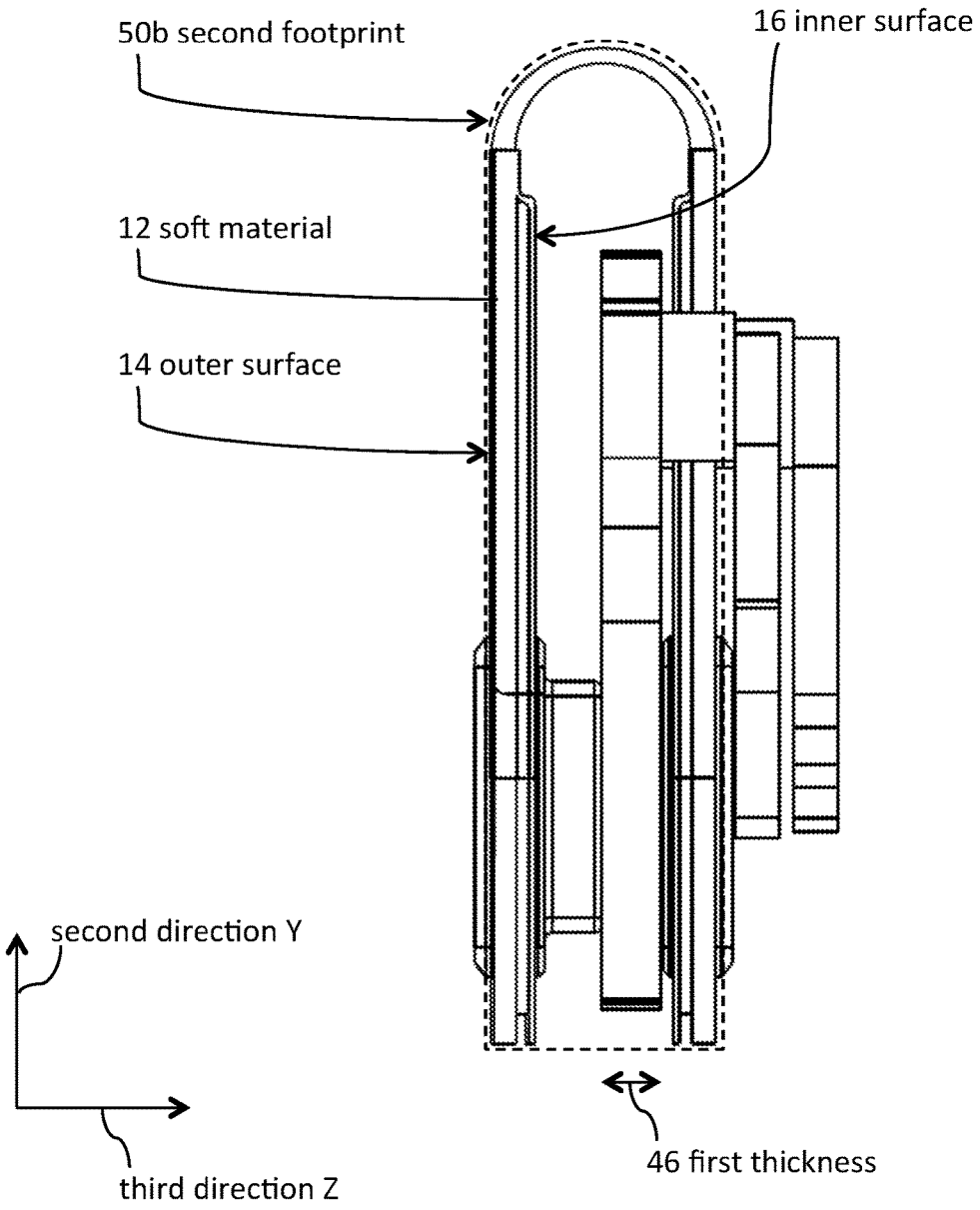
FIG. 10 illustrates a side view of a lens jacket in a closed position with a pair of eyeglasses coupled to the lens jacket, according to embodiments of the present disclosure.

To further illustrate the low profile, sleek design of the lens jacket 10, FIGS. 8-10 illustrate that when the soft material 12 is in the closed position, the soft material 12 defines a first footprint 50*a* that can extend along the first and second directions X, Y. As well, the soft material 12 can define a second footprint 50*b* that can extend along the second and third directions Y, Z. In some embodiments of the lens jacket 10, at least a portion of the eyeglass frame 2 extends outside of the first and second footprints 50*a*, 50*b*. As well, at least a portion of the first earpiece 8*a* can extend outside of the first and second footprints 50*a*, 50*b*, and at least a portion of the second earpiece 8*b* can extend outside of the first and second footprints 50*a*, 50*b*. As such, the lens jacket 10 can securely protect the eyeglass frame 2 and lenses as well as conventional protective cases. Yet because the lens jacket 10 provides a three-dimensional footprint smaller than the eyeglass frame 2 and lenses enclosed within the lens jacket 10, the lens jacket 10 provides a minimalist design on par with conventional protective covers made of cloth.

Figure 11:
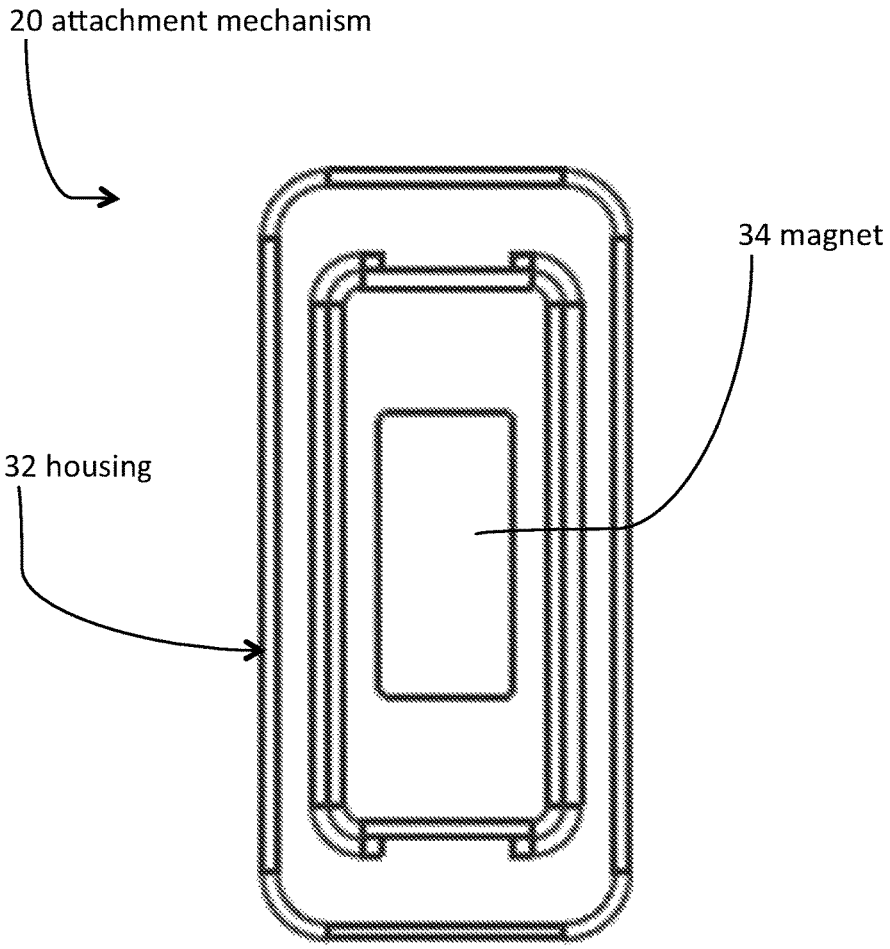
FIG. 11 illustrates a front view of an attachment mechanism, according to embodiments of the present disclosure.

As previously discussed, the lens jacket 10 can also include first and second attachment mechanisms 20*a*, 20*b*. As shown in FIG. 11, the first attachment mechanism 20*a* can include a first plastic housing 32*a* that receives a first magnet 34*a*. Accordingly, the second attachment mechanism 20*b* can include a second plastic housing 32*b* that receives a second magnet 34*b*. The first attachment mechanism 20*a* can thereby be magnetically coupled to the second attachment mechanism 20*b*. In this manner, the first attachment mechanism 20*a* can be securely coupled to the second attachment mechanism 20*b*. However, magnetic coupling is just one example. Embodiments of the lens jacket 10 may use any type of mechanical attachment, such as a friction fit, to secure the first attachment mechanism 20*a* to the second attachment mechanism 20*b*. However, it should be appreciated that any type of attachment means can be used that securely couples the first attachment mechanism 20*a* to the second attachment mechanism 20*b*.

Figure 12:
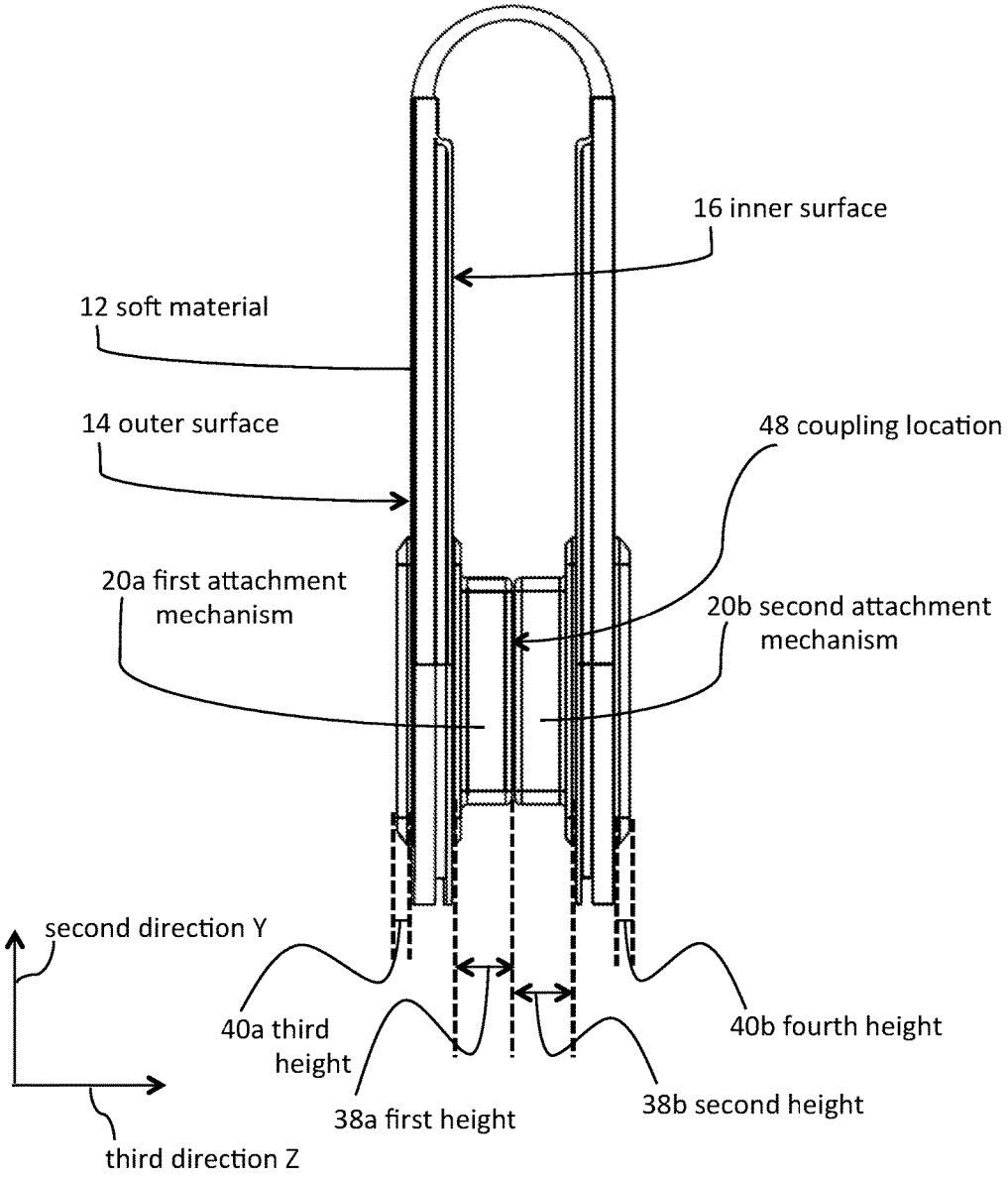
FIG. 12 illustrates a side view of a lens jacket in a closed position, according to embodiments of the present disclosure.

As shown in FIGS. 5 and 12, the first attachment mechanism 20*a* can extend from the inner surface 16 of the soft material 12 at an upper-center location 36*a* of the first portion 22*a*. The first attachment mechanism can extend along a third direction Z that is perpendicular to both the first direction X and the second direction Y. Accordingly, the second attachment mechanism 20*b* can extend from the inner surface 16 of the soft material 12 along a lower-center location 36*b* of the second portion 22*b*. As well, the second attachment mechanism 20*b* can extend along the third direction Z.

Figure 13:
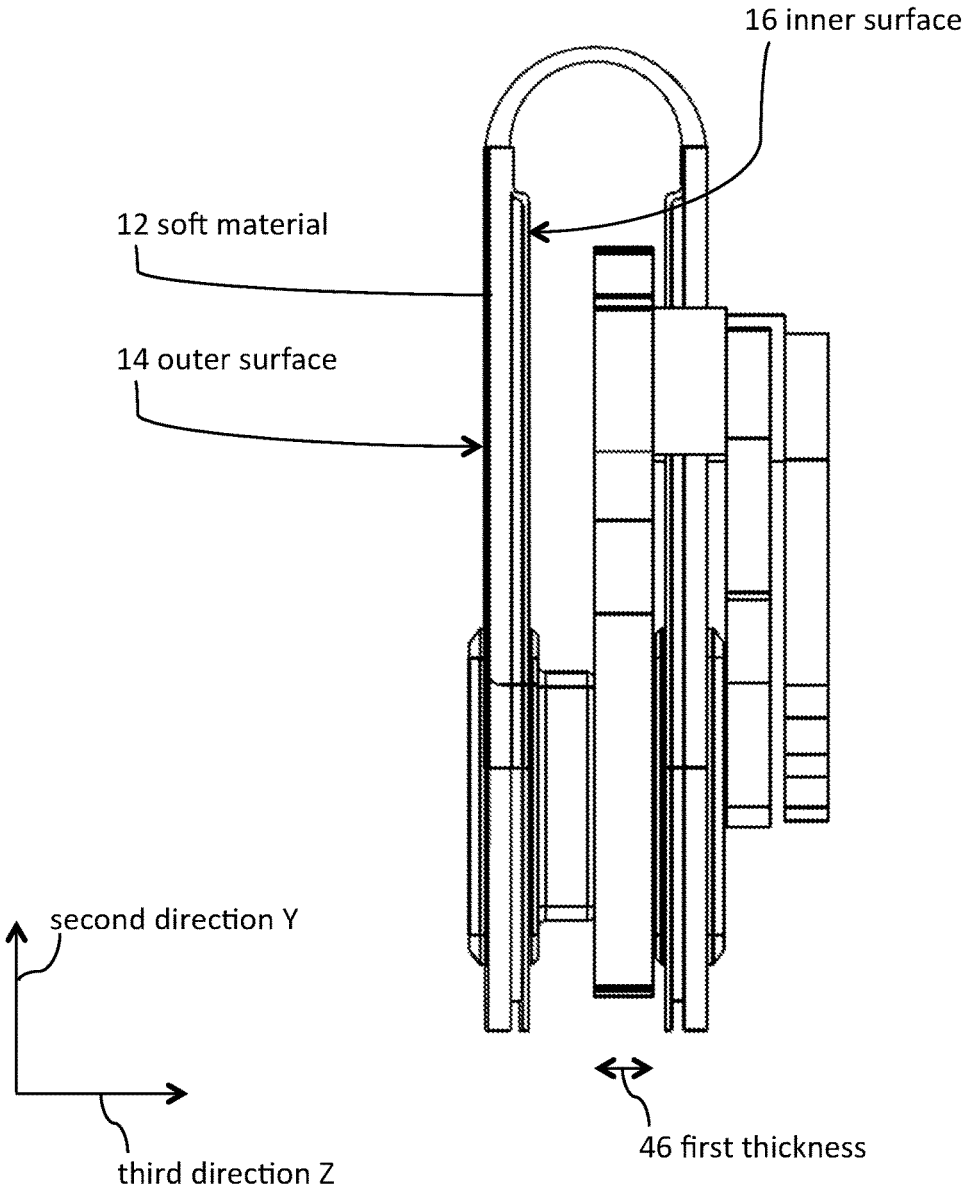
FIG. 13 illustrates a side view of a lens jacket in a closed position with a pair of eyeglasses coupled to the lens jacket, according to embodiments of the present disclosure.

Referring to FIGS. 12 and 13, the first attachment mechanism 20*a* can extend a first height 38*a* from the inner surface 16 and the second attachment mechanism 20*b* can extend a second height 38*b* from the inner surface 16. In some embodiments, the first height 38*a* in addition to the second height 38*b* is greater than a first thickness 46 of the eyeglass frame 2, which extends along the third direction Z. In this manner, the first and second attachment mechanisms 20*a*, 20*b* can be sized to allow enough space for the eyeglass frame 2 to securely, yet snugly fit between the first and second portions 22*a*, 22*b* of the soft material 12. It should be appreciated that the first distance 27 between the first pivot axis 18*a* and the second pivot axis 18*b* can also be greater than the first thickness 46 of the eyeglass frame 2. As well, the first distance 27 can be greater than the first height 38*a* in addition to the second height 38*b*.

Figure 14:
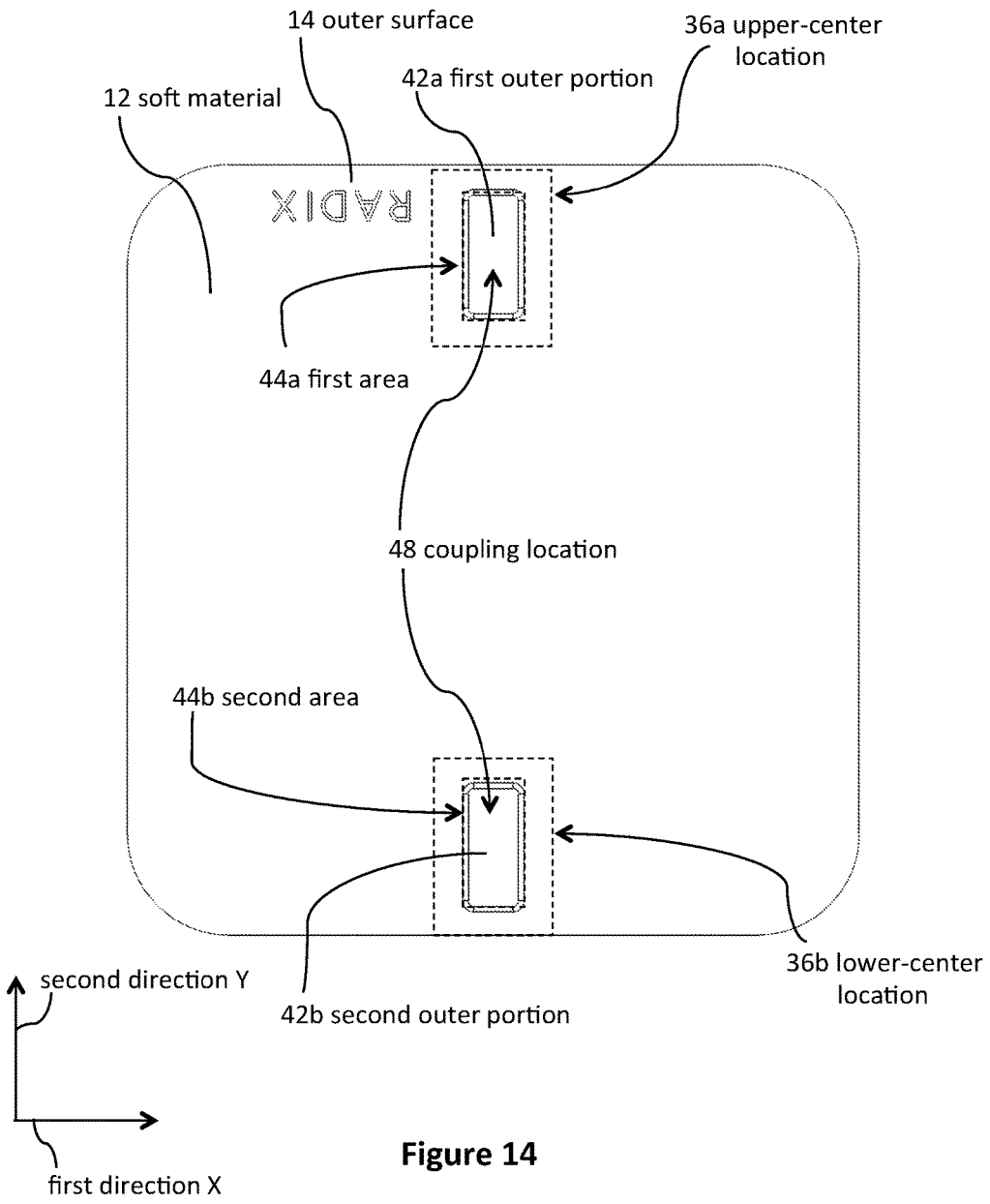
FIG. 14 illustrates a back view of a lens jacket in an open position, according to embodiments of the present disclosure.

Embodiments of the lens jacket 10 can also include features whereby users can securely grip the lens jacket 10. To illustrate, FIGS. 12 and 14 show that a first outer portion 42*a* of the first plastic housing 32*a* can extend from the outer surface 14 of the soft material 12 at the upper-center location 36*a* of the first portion 22*a* whereby the first plastic housing 32*a* extends along the third direction Z. Also, a second outer portion 42*b* of the second plastic housing 32*b* can extend from the outer surface 14 of the soft material 12 at the lower-center location 36*b* of the second portion 22*b* whereby the second plastic housing 32*b* also extends along the third direction Z.

The outer portions 42*a*, 42*b* of the first and second plastic housings 32*a*, 32*b* can be sized and configured in such a manner that a user can conveniently carry or grip the lens jacket 10 by the outer portions 42*a*, 42*b*. For example, the outer portions 42*a*, 42*b* can be raised up from the outer surface 14 to provide easy access for the user. In some embodiments, the outer portion 42*a* of the first plastic housing 32*a* can extend a third height 40*a* from the outer surface 14. As well, the outer portion 42*b* of the second plastic housing 32*b* can extend a fourth height 40*b* from the outer surface 14. In some embodiments, the third height 40*a* is substantially equal to the fourth height 40*b*. Furthermore, the outer portion 42*a* of the first plastic housing 32*a* can define a first area 44*a* sized and shaped to receive a first human finger of a user. Accordingly, the outer portion 42*b* of the second plastic housing 32*b* can define a second area 44*b* sized and shaped to receive a second human finger of the user. In some embodiments, the first area 44*a* is substantially equal to the second area 44*b*.

Figure 15:
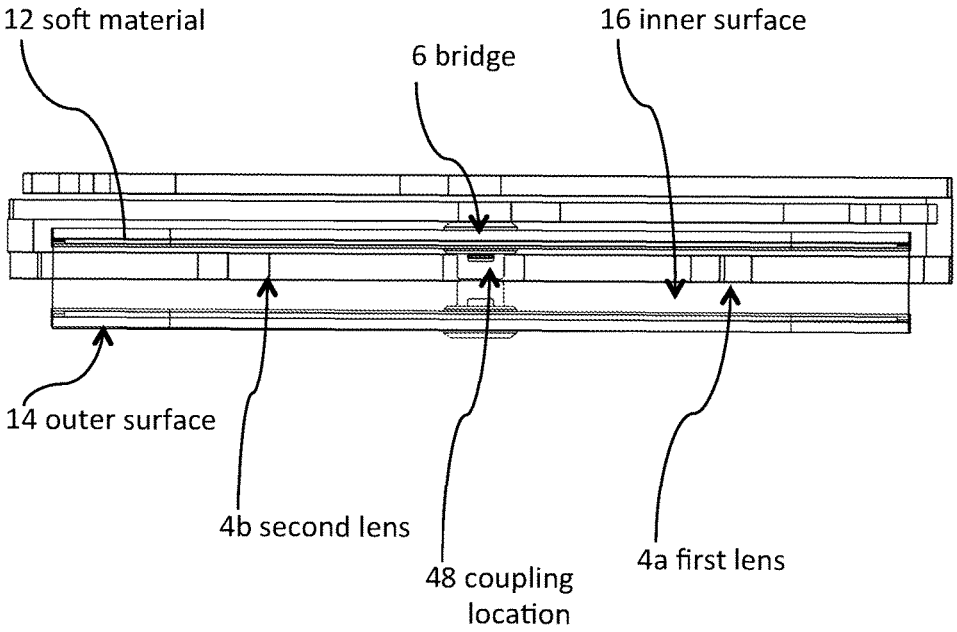
FIG. 15 illustrates a bottom-up view of a lens jacket in a closed position with a pair of eyeglasses coupled to the lens jacket, according to embodiments of the present disclosure.
Figure 15:
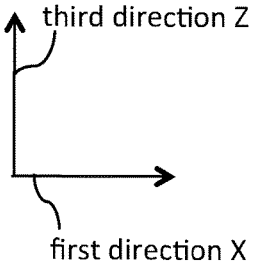

The lens jacket 10 can also provide additional benefits and features not available in prior art eyeglass cases and covers. For example, as shown in FIG. 15, when the soft material 12 is in the closed position 29*b* around the eyeglass frame 2, the first attachment mechanism 20*a* and the second attachment mechanism 20*b* can extend through the aperture 9 of the eyeglass frame 2. In this manner, the coupling location 48 of the first and second attachment mechanisms 20*a*, 20*b* can be located between the first lens 4*a*, second lens 4*b*, and just below the bridge 6 of the eyeglass frame 2. This can allow the user to securely and firmly grab onto the first and second outer portions 42*a*, 42*b*, which are directly above the coupling location 48. This lens jacket 10 can direct the gripping forces from the user's hand directly through the outer portions 42*a*, 42*b* and into the first and second attachment mechanisms 20*a*, 20*b*, not through any part of the eyeglass frame 2 and/or lenses. The user can thereby grip the outer portions 42*a*, 42*b* with the confidence that the firm pressure will not damage the eyeglass frame 2 and/or lenses. In many prior art systems, the coupling location is located along an outer surface of the case so when force (or pressure) is applied to the portion of the case directly above the coupling location, at least part of the force is transmitted through the eyeglass frame 2 and/or lenses, which can cause additional stress and strain that can damage the eyeglass frames and/or lenses.

Figure 16:
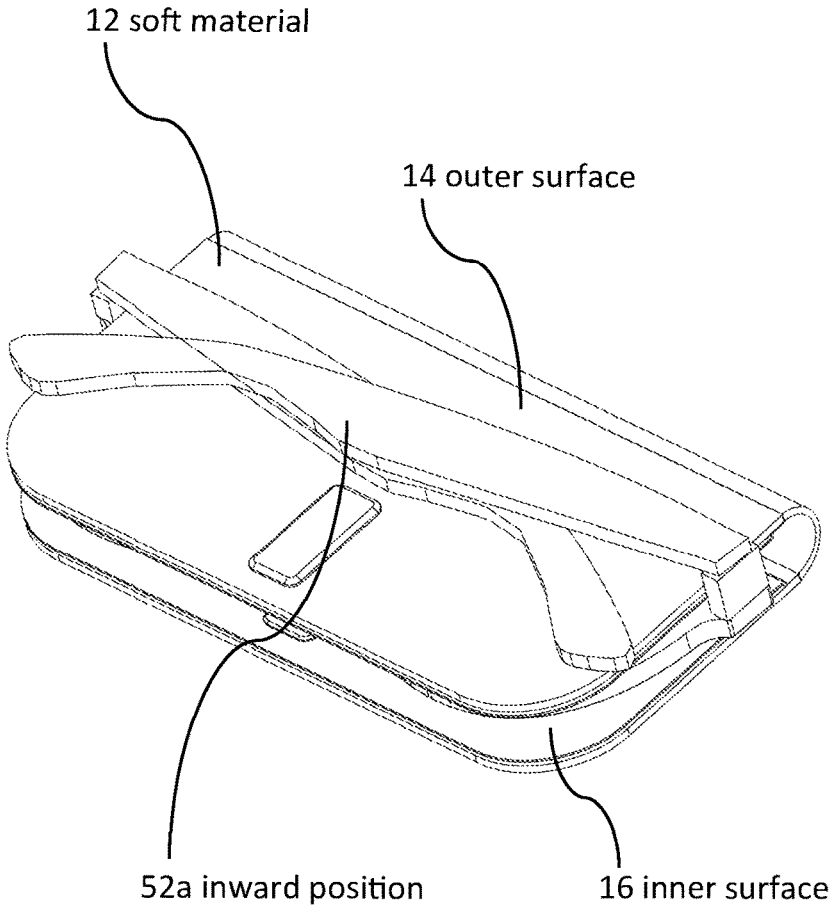
FIG. 16 illustrates a perspective back view of a lens jacket in a closed position with a pair of eyeglasses coupled to the lens jacket, according to embodiments of the present disclosure.
Figure 17:
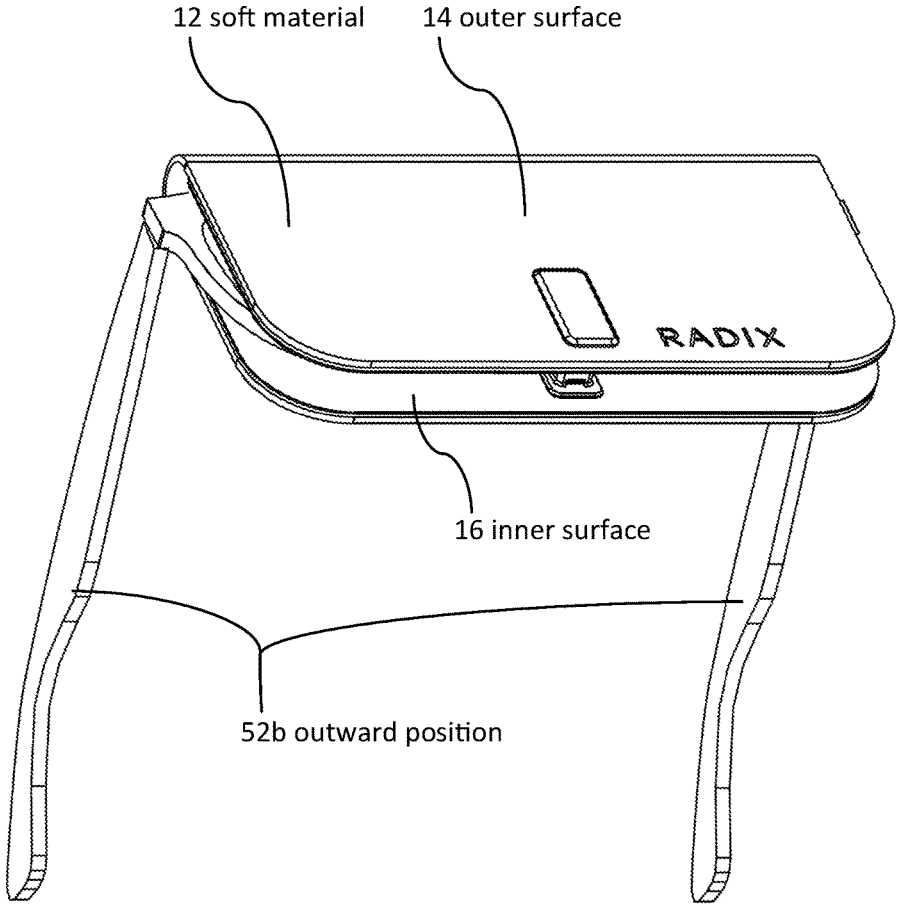
FIG. 17 illustrates a perspective front view of a lens jacket in a closed position with a pair of eyeglasses coupled to the lens jacket with the earpieces in an outward position, according to embodiments of the present disclosure.
Figure 18:
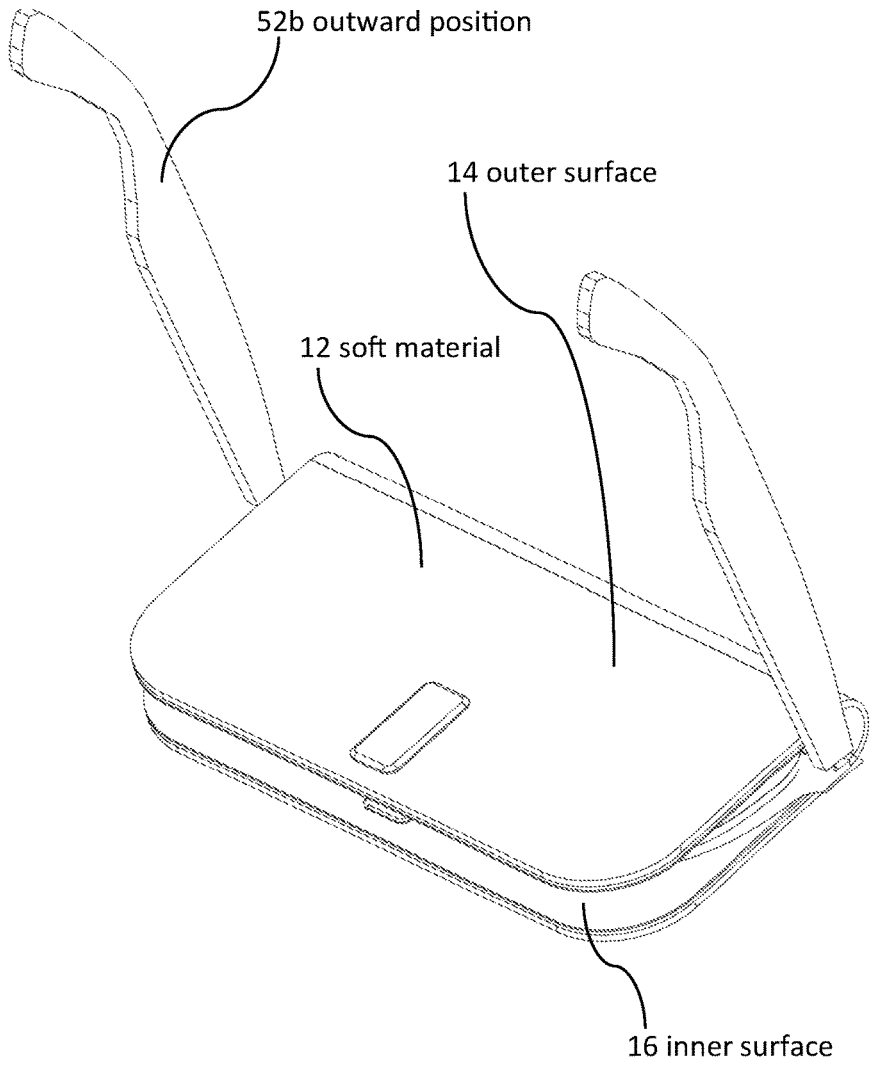
FIG. 18 illustrates a perspective back view of a lens jacket in a closed position with a pair of eyeglasses coupled to the lens jacket with the earpieces in an outward position, according to embodiments of the present disclosure.

Another benefit provided by the lens jacket 10 is that when the soft material 12 is in the closed position 29*b* around the eyeglass frame 2 and the first attachment mechanism 20*a* is coupled to the second attachment mechanism 20*b*, the first earpiece 8*a* and the second earpiece 8*b* can each pivot between an inward position 52*a* and an outward position 52*b*, illustrated in FIGS. 16-18. In this regard, no portion of the soft material 12 covers the first earpiece 8*a* and the second earpiece 8*b*. This can allow retailers and users to couple the lens jacket 10 to a pair of eyeglasses 1 and still be able adjust the earpieces in various positions. For example, retailers may be able to display the lens jacket 10 coupled to a pair of eyeglasses 1 on a display stand, such as one disclosed in U.S. Pat. No. 3,891,092; entitled SUNGLASS DISPLAY STAND; issued on Jun. 24, 1975.

Interpretation

As used herein, the term "susbtantially" can be interpretted to have different meanings depending upon the context. For example, "substantially" can mean two axis that are within 10-degrees of each other. As well, the term "substantially" can be understood to mean that two areas are within 0.25 inches$^2$ of each other. In other contexts, "substantially" can mean two heights are within plus or minus 0.25 inches. In other contexts, "substantially" can mean plus or minus 0.25 inches.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

The following is claimed:

1. A lens jacket configured to cover an eyeglass frame comprising a first lens and a second lens connected by a bridge, the lens jacket comprising:

a soft material that extends along a first direction and a second direction that is perpendicular to the first direction, wherein the soft material comprises an inner surface and an outer surface that faces opposite the inner surface;

a pivot axis that extends through the soft material and extends parallel to the first direction, wherein the pivot axis allows the soft material to fold towards itself such that a first portion of the inner surface faces a second portion of the inner surface; and a first attachment mechanism located along a first portion of the soft material and a second attachment mechanism located along a second portion of the soft material, wherein the first attachment mechanism couples with the second attachment mechanism to thereby retain the soft material in a closed position, wherein an outer portion of the first attachment mechanism extends from the outer surface of the first portion of the soft material and an outer portion of the second attachment mechanism extends from the outer surface of the second portion of the soft material.

2. The lens jacket of claim 1 , wherein the first attachment mechanism comprises a first magnet and the second attachment mechanism comprises a second magnet.

3. The lens jacket of claim 2, wherein the first attachment mechanism comprises a first plastic housing that receives the first magnet, and the second attachment mechanism comprises a second plastic housing that receives the second magnet.

4. The lens jacket of claim 3, wherein the first attachment mechanism extends from the inner surface of the soft material at an upper-center location of the first portion whereby the first attachment mechanism extends along a third direction that is perpendicular to both the first direction and the second direction, and the second attachment mechanism extends from the inner surface of the soft material along a lower-center location of the second portion whereby the second attachment mechanism extends along the third direction.

5. The lens jacket of claim 4, further comprising the eyeglass frame, wherein the first attachment mechanism extends a first height from the inner surface and the second attachment mechanism extends a second height from the inner surface, and wherein the first height in addition to the second height is greater than a first thickness of the eyeglass frame that extends along the third direction.

6. The lens jacket of claim 5, wherein the second portion of the first attachment mechanism extends from the outer surface of the soft material at the upper-center location of the first portion, and the second portion of the second attachment mechanism extends from the outer surface of the soft material at the lower-center location of the second portion.

7. The lens jacket of claim 6, wherein the second portion of the first attachment mechanism extends a third height from the outer surface and the second portion of the second attachment mechanism extends a fourth height from the outer surface, wherein the third height is substantially equal to the fourth height, wherein the second portion of the first attachment mechanism defines a first area sized and shaped to receive a first human finger, and the second portion of the second attachment mechanism defines a second area sized and shaped to receive a second human finger, and wherein the first area is substantially equal to the second area.

8. The lens jacket of claim 5, wherein the pivot axis is a first pivot axis, the lens jacket further comprising a second pivot axis that extends through the soft material and extends substantially parallel to the first pivot axis, wherein the second pivot axis is spaced from the first pivot axis along the second direction, and wherein the second pivot axis allows the soft material to fold towards itself such that the first portion of the inner surface faces the second portion of the inner surface.

9. The lens jacket of claim 8, wherein the second pivot axis is spaced a first distance from the first pivot axis, wherein the first distance is greater than the first thickness of the eyeglass frame, and wherein the first distance is greater than the first height in addition to the second height.

10. The lens jacket of claim 8, wherein an inner portion of the first portion of the soft material comprises a first firm material, an inner portion of the second portion of the soft material comprises a second firm material, and an inner portion of the soft material between the first axis and the second axis is devoid of firm material.

11. The lens jacket of claim 10, wherein the inner surface comprises microfiber and the outer surface comprises vegan leather.

12. The lens jacket of claim 1, wherein an inner portion of the first attachment mechanism extends from the inner surface of the first portion of the soft material and an inner portion of the second attachment mechanism extends from the inner surface of the second portion of the soft material.

13. The lens jacket of claim 1, wherein both the first portion of the first attachment mechanism and the first portion of the second attachment mechanism comprise plastic, and both the second portion of the first attachment mechanism and the second portion of the second attachment mechanism comprise plastic.

14. A lens jacket configured to cover an eyeglass frame comprising a first lens and a second lens connected by a bridge, the lens jacket comprising:

a soft material that extends along a first direction and a second direction that is perpendicular to the first direction, wherein the soft material comprises an inner surface and an outer surface that faces opposite the inner surface;

a pivot axis that extends through the soft material and extends parallel to the first direction, wherein the pivot axis allows the soft material to fold towards itself such that a first portion of the inner surface faces a second portion of the inner surface;

a first attachment mechanism that extends from the inner surface of the first portion of the soft material along a third direction and extends from the outer surface of the second portion of the soft material along the third direction that is perpendicular to the first direction and the second direction; and a second attachment mechanism that extends from the inner surface of the second portion of the soft material along the third direction and extends from the outer surface of the second portion of the soft material along the third direction, wherein the first attachment mechanism couples with the second attachment mechanism at a coupling location to thereby retain the soft material in a closed position.

15. The lens jacket of claim 14, further comprising the eyeglass frame, wherein the coupling location is further positioned between the first lens and second lens just below the bridge of the eyeglass frame.

16. The lens jacket of claim 15, wherein the soft material defines a first width that extends along the first direction and the eyeglass frame defines a second width that extends along the first direction, and the second width is greater than the first width.

17. The lens jacket of claim 16, wherein the first width is sized with respect to the second width so that the eyeglass frame is securely coupled to the lens jacket when the soft material is in the closed position around the eyeglass frame.

18. The lens jacket of claim 15, wherein a first earpiece and second earpiece are coupled to the eyeglass frame, and wherein when the soft material is in the closed position around the eyeglass frame and the first attachment mechanism is coupled to the second attachment mechanism, no portion of the soft material covers the first earpiece and the second earpiece.

19. The lens jacket of claim 18, wherein when the soft material is in the closed position, the soft material defines a first footprint that extends along the first and second directions, and the soft material defines a second footprint that extends along the second and third directions, and wherein at least a portion of the eyeglass frame extends outside of the first and second footprints.

20. The lens jacket of claim 19, wherein at least a portion of the first earpiece extends outside of the first and second footprints, and at least a portion of the second earpiece extends outside of the first and second footprints.

* * * * *